US011542728B2

(12) United States Patent
Tanaka et al.

(10) Patent No.: US 11,542,728 B2
(45) Date of Patent: Jan. 3, 2023

(54) VEHICLE DOOR LOCK DEVICE

(71) Applicants: AISIN CORPORATION, Kariya (JP); HONDA MOTOR CO., LTD., Tokyo (JP)

(72) Inventors: Yuichiro Tanaka, Kariya (JP); Yasuhiko Sono, Kariya (JP); Junichiro Takagi, Okazaki (JP); Satoshi Endo, Wako (JP)

(73) Assignees: AISIN CORPORATION, Aichi (JP); HONDA MOTOR COMPANY, Tokyo (JP)

( * ) Notice: Subject to any disclaimer, the term of this patent is extended or adjusted under 35 U.S.C. 154(b) by 602 days.

(21) Appl. No.: 16/590,669

(22) Filed: Oct. 2, 2019

(65) Prior Publication Data

US 2020/0102770 A1 Apr. 2, 2020

(30) Foreign Application Priority Data

Oct. 2, 2018 (JP) ..... JP2018-187253

(51) Int. Cl.
*E05B 79/20* (2014.01)
*E05B 77/04* (2014.01)
*E05B 85/02* (2014.01)

(52) U.S. Cl.
CPC ..... *E05B 77/04* (2013.01); *E05B 79/20* (2013.01); *E05B 85/02* (2013.01);
(Continued)

(58) Field of Classification Search
CPC ... E05B 79/20; E05B 85/02; E05Y 2600/626; F16C 1/102; Y10S 292/11; Y10T 292/1047; Y10T 292/1082; Y10T 292/20
(Continued)

(56) References Cited

U.S. PATENT DOCUMENTS 1,382,501 A * 6/1921 Graham ..... B65D 45/32 292/256.61
1,450,687 A * 4/1923 Kunin ..... A47J 36/10 24/486
(Continued)

FOREIGN PATENT DOCUMENTS

CN 104024548 A * 9/2014 ..... E05B 79/20
CN 104662244 A * 5/2015 ..... E05B 79/20
(Continued)

OTHER PUBLICATIONS

Office Action dated Dec. 17, 2019, by the Japanese Patent Office in corresponding Japanese Patent Application No. 2018-187253, and a partial English Translation of the Office Action. (4 pages).

*Primary Examiner* — Carlos Lugo
(74) *Attorney, Agent, or Firm* — Buchanan Ingersoll & Rooney PC

(57) ABSTRACT

Provided is a vehicle door lock device capable of preventing a vehicle door from being opened accidentally even when the vehicle door is deformed. A vehicle door lock device includes: a housing including: a case having an opening portion; and a cover, which is mounted to the case so as to be openable and closable, and is configured to cover the opening portion; a cam mechanism, which is accommodated in the housing, and is supported on the case; and a bracket configured to restrain a cable which is locked to a locking portion formed on the housing, and is configured to connect the cam mechanism and an operation element provided to a door of a vehicle from being released from the locking portion when the cable connected to the cam mechanism in the opening portion is pressed toward the cover side.

1 Claim, 12 Drawing Sheets

(52) U.S. Cl.
CPC ..... *E05Y 2201/10* (2013.01); *E05Y 2201/638* (2013.01); *E05Y 2600/626* (2013.01); *E05Y 2900/531* (2013.01)

(58) Field of Classification Search
USPC ..... 74/502.6
See application file for complete search history.

(56) References Cited

U.S. PATENT DOCUMENTS

| | | | | | |
|---|---|---|---|---|---|
| 1,941,294 | A * | 12/1933 | Eck | A47J 27/0811 | 220/325 |
| 2,639,834 | A * | 5/1953 | Medley | F02M 1/00 | 220/325 |
| 4,967,987 | A * | 11/1990 | Swank | F16C 1/106 | 248/68.1 |
| 6,889,574 | B2 * | 5/2005 | Meyer | F16C 1/105 | 74/502.6 |
| 7,637,542 | B2 * | 12/2009 | Suzumura | E05B 85/02 | 292/201 |
| 8,684,425 | B2 * | 4/2014 | Nagaoka | E05B 81/16 | 292/201 |
| 9,834,962 | B2 | 12/2017 | Suzumura et al. | | |
| 10,196,838 | B2 * | 2/2019 | Nagaoka | E05B 85/02 | |
| 10,323,681 | B2 * | 6/2019 | Hundsdorfer | F16C 1/105 | |
| 10,526,823 | B2 * | 1/2020 | Nagata | B60J 5/00 | |
| 2016/0168882 | A1 * | 6/2016 | Chung | E05B 79/20 | 292/92 |

FOREIGN PATENT DOCUMENTS

| | | | | | |
|---|---|---|---|---|---|
| CN | 107130865 | A * | 9/2017 | E05B 85/02 | |
| DE | 19924028 | A1 * | 11/2000 | E05B 79/20 | |
| DE | 102005059833 | A1 * | 8/2006 | E05B 79/20 | |
| DE | 102006059583 | A1 * | 6/2008 | E05B 79/04 | |
| GB | 2483965 | A * | 3/2012 | E05B 77/265 | |
| GB | 2517305 | A * | 2/2015 | E05B 77/44 | |
| GB | 2517306 | A * | 2/2015 | E05B 77/44 | |
| JP | 2012180702 | A | 9/2012 | | |
| JP | 2014062441 | A | 4/2014 | | |
| JP | 2016-037699 | A | 3/2016 | | |
| JP | 2018071322 | A | 5/2018 | | |
| WO | WO-02055818 | A1 * | 7/2002 | E05B 79/20 | |
| WO | WO-2015118916 | A1 * | 8/2015 | E05B 77/34 | |

* cited by examiner

VEHICLE DOOR LOCK DEVICE

TECHNICAL FIELD

This disclosure relates to a vehicle door lock device.

BACKGROUND DISCUSSION

For example, in JP 2014-062441 A, a vehicle door lock device is described. The vehicle door lock device includes a cam mechanism (a latch mechanism and a lock mechanism) including, for example, a latch, a pole, a lift lever, an open link, an open lever, and an active lever. Operation elements (such as a door handle and a door lock knob) are provided to a door of a vehicle. Each of the operation elements is connected to the cam mechanism of the vehicle door lock device through a cable (coupling member). When each of the operation elements is operated, the operating force is transmitted to the cam mechanism through the cable.

The vehicle door lock device includes a housing configured to accommodate the above-mentioned cam mechanism. The housing includes a case and a cover (see FIG. 12). The case is a substantially box-shaped member of a thin type (shallow type). A depth direction of the case corresponds to a thickness direction of the door (or a vehicle width direction (right-and-left direction) under a state in which the door is closed). In the example illustrated in FIG. 12, an opening portion is formed at a lower part of a side surface portion of the case on a vehicle interior side. The cover is a cover member configured to cover the opening portion. A hinge portion is formed at a lower edge portion of the cover, and the hinge portion is assembled to the opening portion. That is, the cover is assembled to the case so as to be openable and closable. Claw portions are formed at an upper edge portion of the cover, and the claw portions are fitted to an upper edge portion of the opening portion. In this manner, a closed state of the cover is kept. Some components of the cam mechanism are in the opening portion. Under a state in which the cover is opened, a distal end of the cable is mounted to the cam mechanism (such as the open lever and the active lever). Then, the cover is closed. In the example illustrated in FIG. 12, the cables are pulled out from a front end surface of the case upward and forward.

SUMMARY

The above-mentioned cable (coupling member) includes a tubular outer cable, and a wire-like inner cable inserted through the outer cable. An end portion of the outer cable is locked to a locking portion formed in the opening portion, and an end portion of the inner cable is mounted to the cam mechanism. For example, one end portion of the inner cable is connected to the open lever of the cam mechanism, and another end portion thereof is connected to the door handle. When the door handle is pulled under a state in which the vehicle door is closed, the open lever is pulled by the inner cable in a predetermined direction to pivot. In this manner, for example, the lift lever, the pole, and the latch pivot in predetermined directions, and retention of the door by the latch is cancelled. As a result, the vehicle door can be opened.

For example, in some cases, at the time of collision of the vehicle, a door panel of the vehicle door is deformed and slightly dented toward the vehicle interior side, and the cable is pressed by the door panel toward the vehicle interior side. Then, the cable presses the cover toward the vehicle interior side. As a result, the cover may be opened as illustrated in FIG. 13. In this case, the outer cable may be released from the locking portion. Thus, even though the door handle is not operated, the open lever forming the cam mechanism may be pulled. As a result, the vehicle door may be opened accidentally.

A need thus exists for a vehicle door lock device which is not susceptible to the drawback mentioned above.

In order to achieve the above-mentioned object, according to at least one embodiment of the present disclosure, there is provided a vehicle door lock device (1), including: a housing (20) including: a case (21) having an opening portion (OP); and a cover (22), which is mounted to the case so as to be openable and closable, and is configured to cover the opening portion; a cam mechanism (10), which is accommodated in the housing, and is supported on the case; and a bracket (23, 23A, 23B) configured to restrain a coupling member which is locked to a locking portion (EP1) formed on the housing, and is configured to connect the cam mechanism and an operation element (DH) provided to a door (FD) of a vehicle from being released from the locking portion when the coupling member connected to the cam mechanism in the opening portion is pressed toward the cover side.

According to at least one embodiment of the present disclosure, even when the vehicle door is deformed to press the coupling member, the bracket restrains the coupling member from being released from the locking portion. Therefore, such a situation that the cam mechanism is pulled by the coupling member accidentally does not occur. Accordingly, even when the vehicle door is deformed, the vehicle door can be prevented from being opened accidentally.

DETAILED DESCRIPTION

Figure 1:
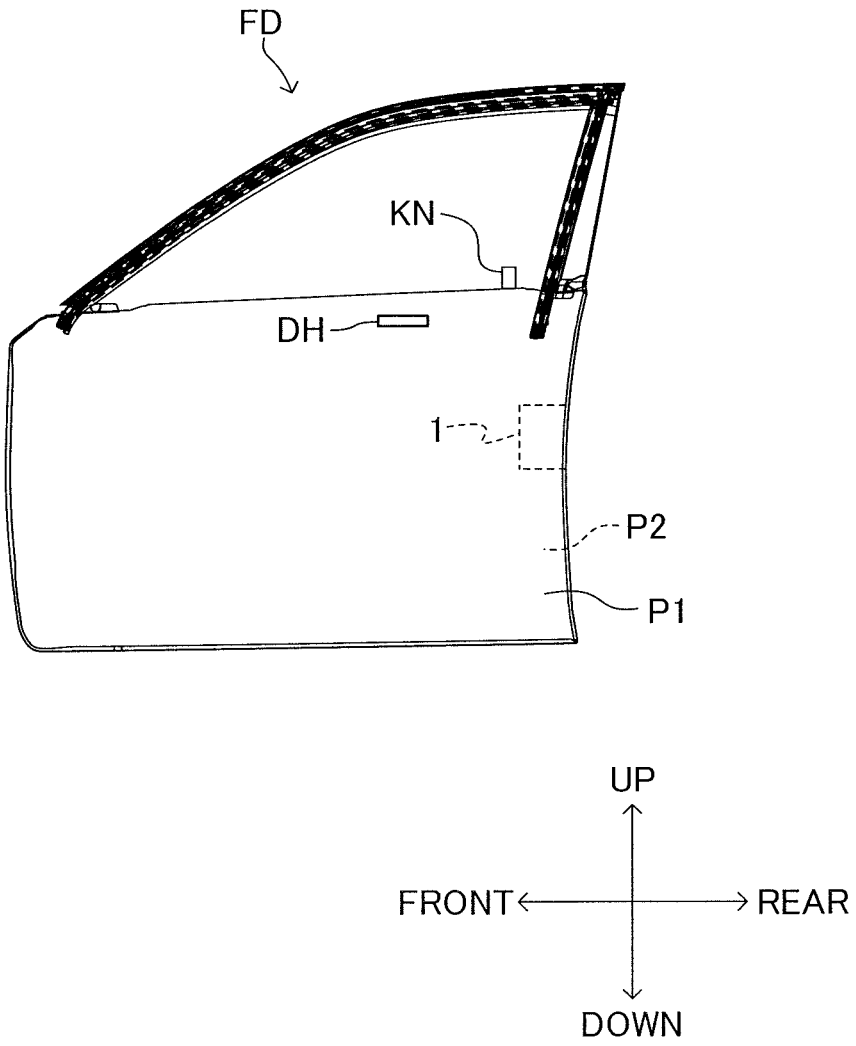
FIG. 1 is a side view for illustrating a right-side front door of a vehicle to which a vehicle door lock device according to one embodiment of the present disclosure is assembled, as seen from a vehicle interior side.

Now, description is made of a vehicle door lock device 1 according to an embodiment of the present disclosure. For example, as illustrated in FIG. 1, the vehicle door lock device 1 is applied to a right-side front door FD of a vehicle. A front end surface of the front door FD is assembled in a doorway through a hinge (not shown). The doorway is formed in a side surface portion of a main body of the vehicle. The front door FD pivots about an axis of the hinge to open and close the doorway of the vehicle. Various directions in the following description represent directions under a state in which the front door FD is closed.

The vehicle door lock device 1 is arranged between an inner panel P1 (vehicle-interior-side panel) and an outer panel P2 (vehicle-exterior-side panel) of the front door FD.

Figure 2:
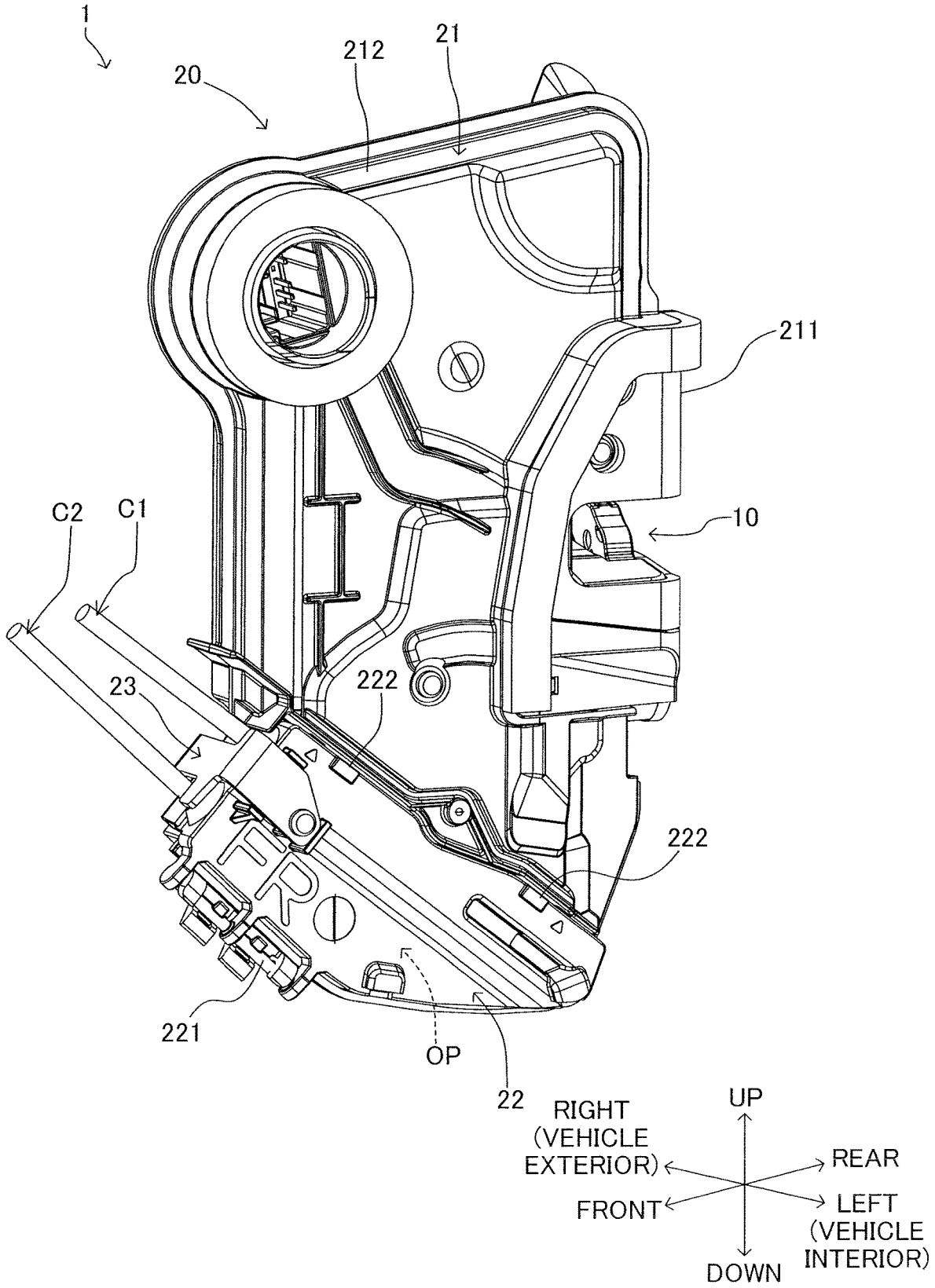
FIG. 2 is a perspective view for illustrating the vehicle door lock device.

As illustrated in FIG. 2, the vehicle door lock device 1 includes a cam mechanism 10 and a housing 20. The cam mechanism 10 includes, for example, a latch mechanism and a lock mechanism. The cam mechanism 10 is accommodated inside the housing 20.

The cam mechanism 10 has a configuration similar to that of a cam mechanism of a well-known vehicle door lock device. In the following, the latch mechanism and the lock mechanism forming the cam mechanism 10 are briefly described. The latch mechanism includes, for example, a latch, a pole, and a lift lever similar to those of the well-known vehicle door lock device. The latch mechanism is configured to keep the front door FD in a closed state through engagement with a striker mounted to a peripheral edge portion of the doorway of the vehicle body.

The latch is a substantially disk-shaped member supported so as to be pivotable about a shaft member extending in a front-and-rear direction of the vehicle. The latch has a cutout portion extending from an outer peripheral surface of the latch toward an inner side. When a pivot position of the latch is at an unlatched position, the front door FD is in a state in which an opening operation thereof is allowed. When the front door FD is closed from this state, the latch receives the striker in the cutout portion, and pivots in a predetermined direction. Then, the pole is engaged with the latch, thereby keeping the front door FD in the closed state. That is, the pole keeps the pivot position of the latch at a latched position (a state in which the opening operation of the vehicle door is not allowed). The pole is engaged with the lift lever. The lift lever is engaged with an open lever through an open link. Further, the open lever and a door handle DH (see FIG. 1) provided to the front door FD are coupled to each other by a cable C1 described later (see FIG. 2). When the door handle DH is pulled, the open lever, the lift lever, and the pole pivot so that the pole and the latch are disengaged from each other. In this manner, the pivot position of the latch is changed to the unlatched position (a state in which the opening operation of the front door FD is allowed).

The lock mechanism is configured to switch states of the vehicle door lock device 1 between an unlocked state, in which the latch mechanism and the striker are disengageable, and a locked state, in which the latch mechanism and the striker are not disengageable. The lock mechanism includes an active lever.

The active lever is supported so as to be pivotable about a shaft member extending in a right-and-left direction of the vehicle. The active lever and an operation element for locking and unlocking (such as a door lock knob KN (see FIG. 1)) are coupled to each other by a cable C2 described later (see FIG. 2). Further, the active lever is connected to the open link. When the operation element for locking and unlocking is set in the unlocked state, the pivot position of the active lever is at a predetermined unlocked position. Under this state, the open lever and the lift lever are engaged with each other, and an operating force applied to the door handle DH is transmitted to the pole. Meanwhile, when the operation element for locking and unlocking is set in the locked state, the active lever pivots in the predetermined direction, and the open link moves so that the open lever and the lift lever are disengaged from each other. Accordingly, an operating force applied to the door handle DH is not transmitted to the pole.

With regard to more specific configurations of the latch mechanism and the lock mechanism described above, for example, a latch unit and an actuator unit disclosed in JP 2017-95954 A are referred.

Next, description is made of a configuration of the housing 20. The housing 20 is made of a synthetic resin. As illustrated in FIG. 2, the housing 20 includes a case 21, a cover 22, and a bracket 23. The case 21 is a box-shaped member of a thin type (shallow type). The case 21 includes a first case 211 and a second case 212. The first case 211 is configured to mainly accommodate the latch mechanism. The second case 212 is configured to mainly accommodate the lock mechanism. A depth direction of the first case 211 corresponds to the front-and-rear direction. A depth direction of the second case 212 corresponds to the right-and-left direction. The first case 211 slightly protrudes from a rear end surface of the second case 212 to a right side (vehicle exterior side).

Figure 3A:
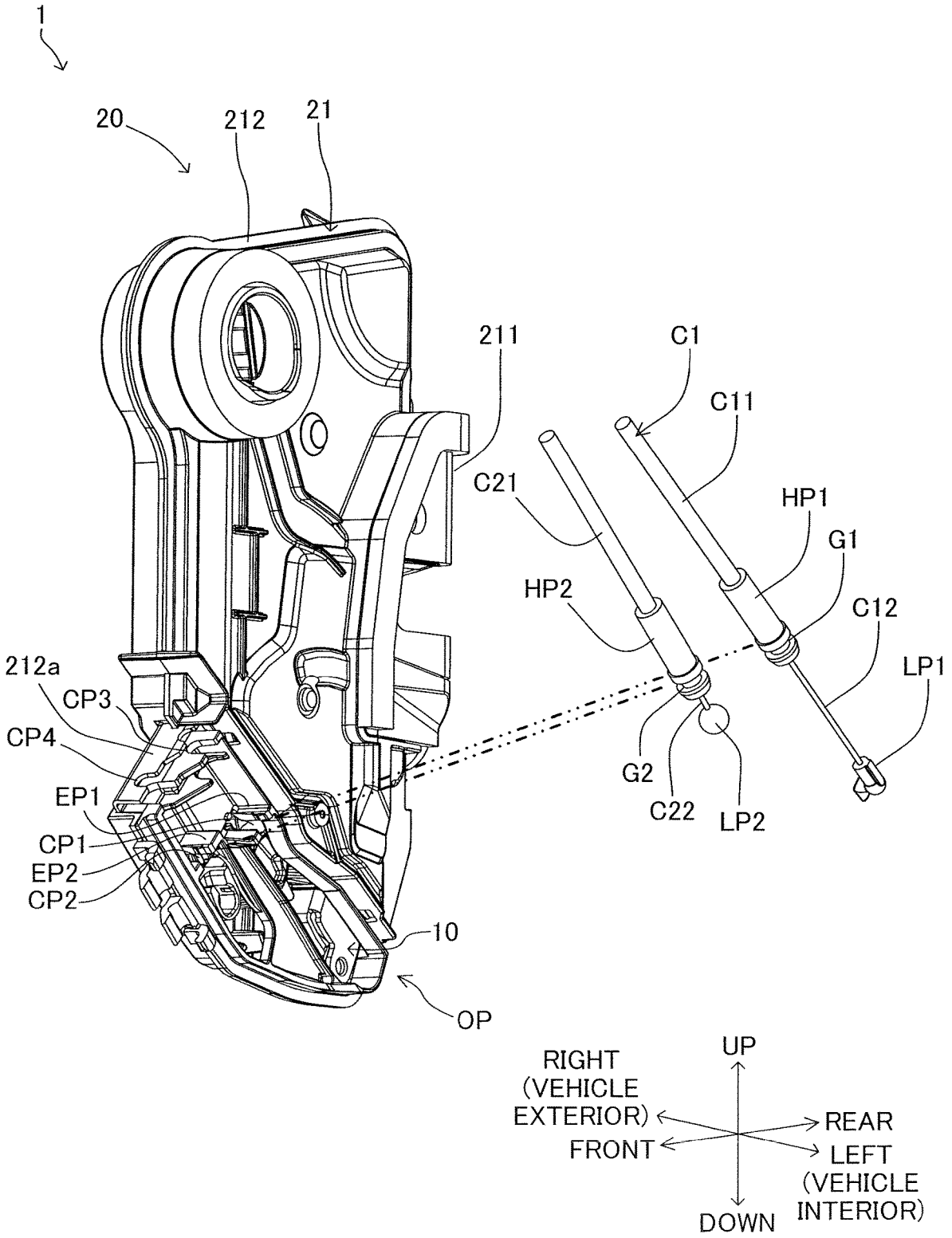
FIG. 3A is a perspective view for illustrating a step of assembling cables to the vehicle door lock device.
Figure 3B:
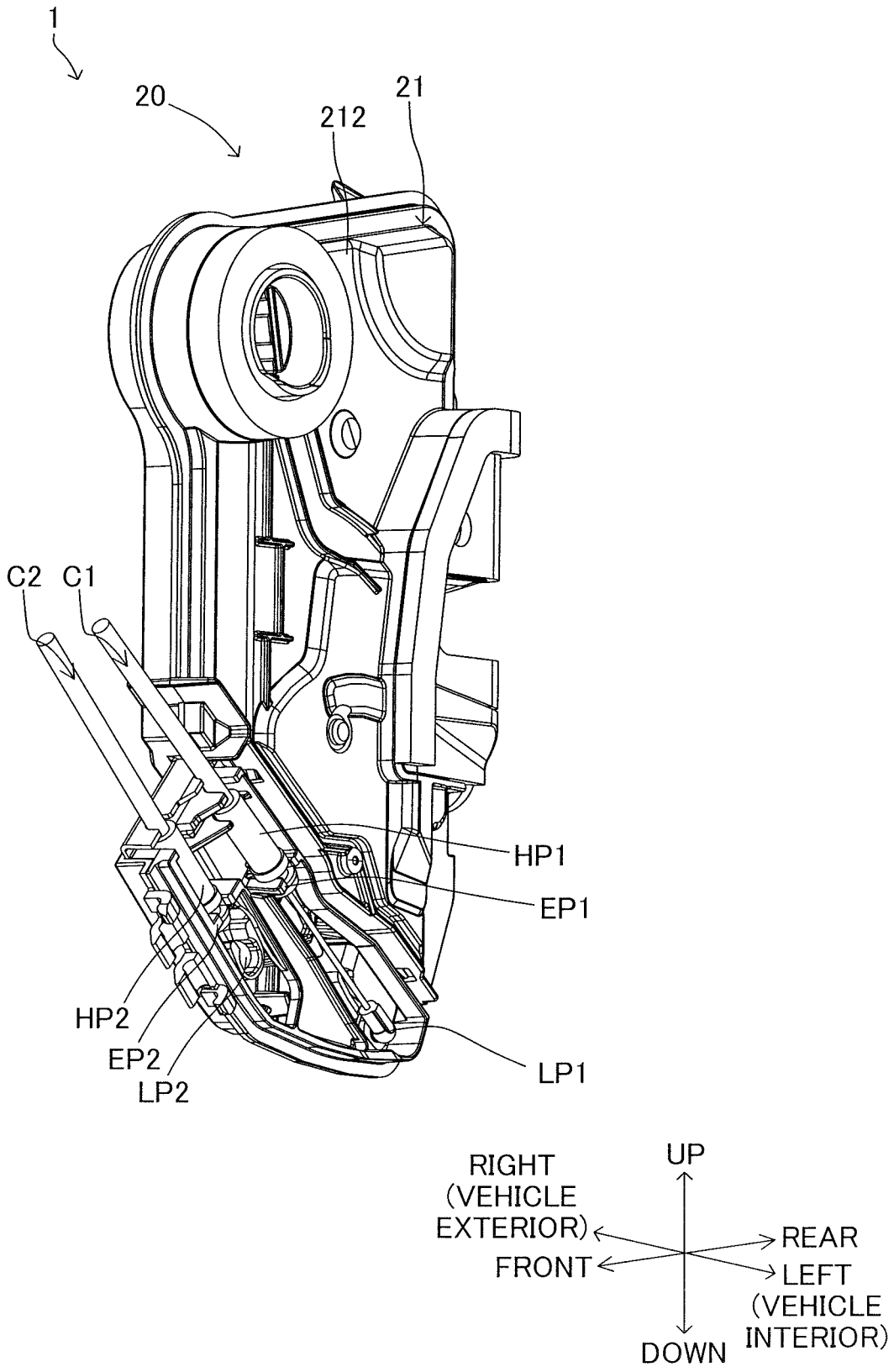
FIG. 3B is a perspective view for illustrating a state in which the cables are assembled to the vehicle door lock device.

An opening portion OP is formed at a lower end portion of the second case 212 and in a side surface portion of the second case 212 on a left side (vehicle-interior-side) (see FIG. 3A and FIG. 3B). Among components of the latch mechanism and the lock mechanism, end portions of some components (the open lever and the active lever) are located in the opening portion OP. The opening portion OP is covered by the cover 22 having a substantially plate shape (see FIG. 2). In FIG. 3A and FIG. 3B, the cover 22 is omitted.

The cover 22 is made of a synthetic resin. A hinge portion 221 is formed at a lower end portion of the cover 22, and the cover 22 is hinged to the lower end portion of the second case 212 (see FIG. 2). That is, the cover 22 is mounted to the second case 212 so as to be openable and closable. Claw portions 222 are formed on an upper peripheral edge portion of the cover 22. The claw portions 222 are locked to the peripheral edge portion of the opening portion OP of the second case 212, thereby keeping a closed state of the cover 22.

As illustrated in FIG. 3A and FIG. 3B, under a state in which the cover 22 is opened, one end of the cable C1 and one end of the cable C2 are connected to the open lever and the active lever, respectively. The cables C1 and C2 correspond to a coupling member of the present disclosure.

The cable C1 includes an outer cable C11 and an inner cable C12. The outer cable C11 is a tubular member made of a synthetic resin. The inner cable C12 is a wire made of a metal, and is inserted through the outer cable C11. Both end portions of the inner cable C12 protrude outward from both end portions of the outer cable C11, respectively. A holder HP1 is mounted to one end portion (end portion on the vehicle door lock device 1 side) of the outer cable C11.

The holder HP1 is a substantially cylindrical member made of a metal, and covers the one end portion of the outer cable C11. A groove G1 is formed in a peripheral surface portion of a distal end portion of the holder HP1 to extend along a circumferential direction of the holder HP1.

As illustrated in FIG. 3A and FIG. 3B, a locking portion EP1 corresponding to the cable C1 is formed in the opening portion OP. The locking portion EP1 is a plate-shaped portion perpendicular to a forward direction and an upward direction. A cutout portion CP1 is formed to extend from an end portion of the locking portion EP1 on the left side (vehicle interior side) toward the right side (vehicle exterior side). The groove G1 of the holder HP1 is inserted and fitted in the cutout portion CP1. In this manner, the one end portion of the outer cable C11 is locked to the second case 212.

Figure 8:
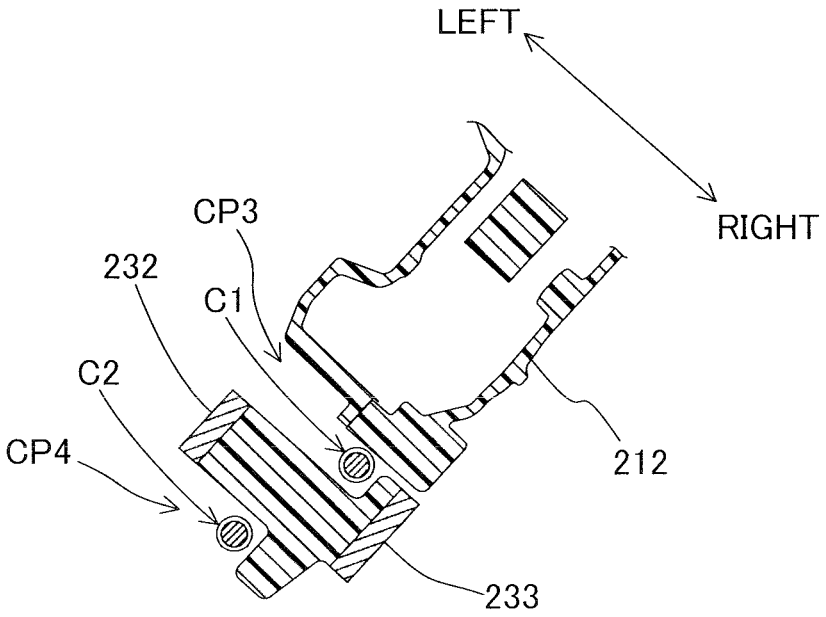
FIG. 8 is a sectional view taken along the line B-B of FIG. 6.

Further, a coupler LP1 is mounted to one end portion of the inner cable C12. The coupler LP1 is connected to the open lever. A cutout portion CP3 corresponding to the cable C1 is formed in a peripheral wall portion 212*a* of the second case 212. The cable C1 is pulled out of the housing 20 through the cutout portion CP3 (see FIG. 3A and FIG. 8). Another end portion of the cable C1 is mounted to the door handle DH (see FIG. 1).

A configuration and a mounting mode of the cable C2 are the same as those of the cable C1. That is, the cable C2 includes an outer cable C21 and an inner cable C22. A locking portion EP2 corresponding to the cable C2 is formed in the opening portion OP. A configuration of the locking portion EP2 is the same as that of the locking portion EP1. The locking portion EP2 is located below the locking portion EP1. A groove G2 of a holder HP2 provided at one end portion (end portion on the vehicle door lock device 1 side) of the outer cable C21 is inserted and fitted in a cutout portion CP2 of the locking portion EP2. In this manner, the one end portion of the outer cable C21 is locked to the second case 212.

Further, a coupler LP2 provided at one end portion of the inner cable C22 is connected to the active lever. A cutout portion CP4 corresponding to the cable C2 is formed in a peripheral wall portion 212*a* of the second case 212 (see FIG. 3A and FIG. 8). The cable C2 is pulled out of the housing 20 through the cutout portion CP4. Another end portion of the cable C2 is mounted to the door lock knob KN (see FIG. 1).

Figure 4:
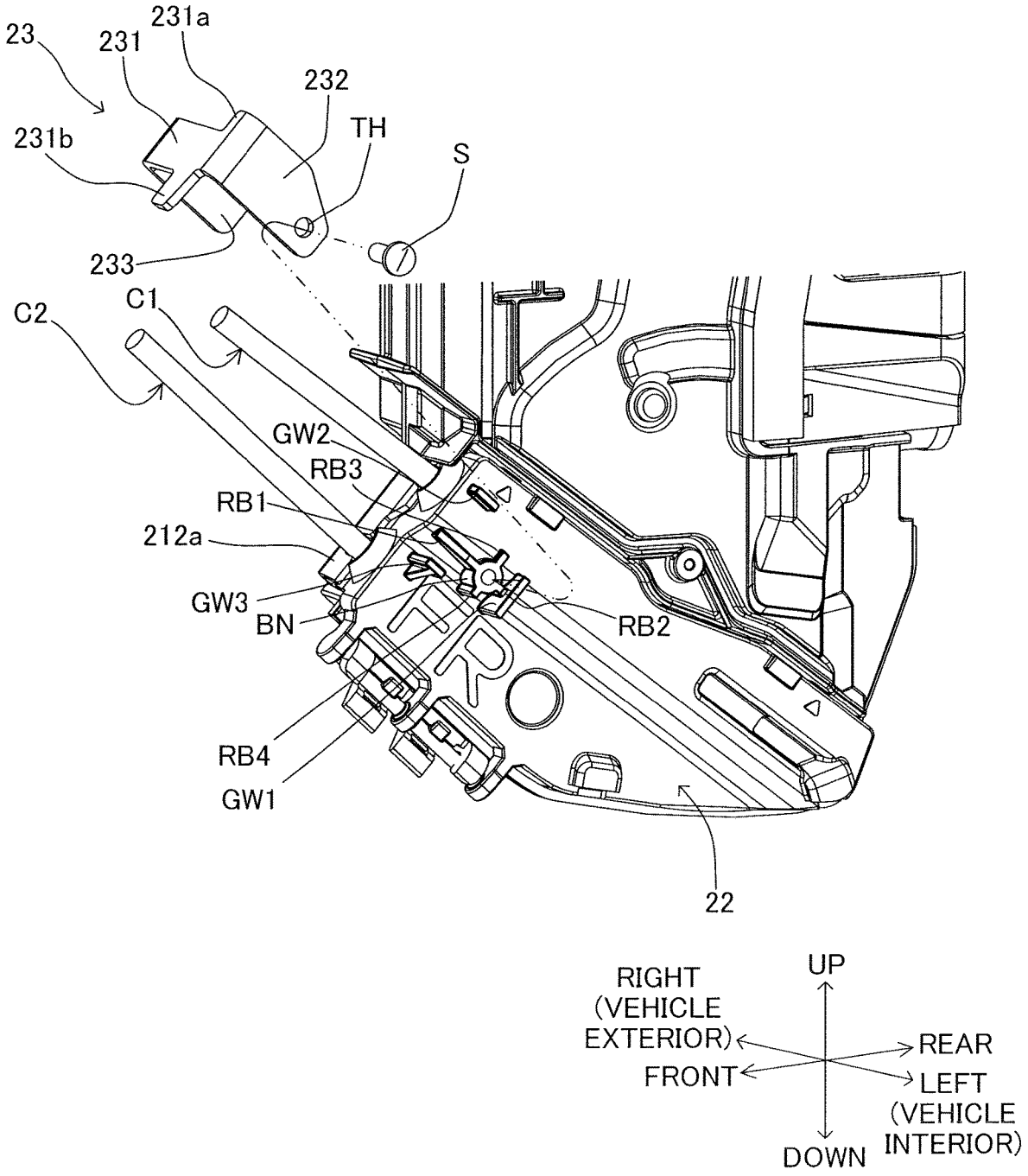
FIG. 4 is a perspective view for illustrating a step of assembling a bracket to a case and a cover.

Under the state in which the cable C1 and the cable C2 are respectively mounted to the open lever and the active lever as described above, the cover 22 is closed. Under the state in which the cover 22 is closed, the holder HP1 and the holder HP2 cannot be respectively released from the locking portion EP1 and the locking portion EP2 to the left side. As illustrated in FIG. 4, the bracket 23 to be described next is mounted to the lower end portion of the second case 212 and at vicinities of outlets for the cable C1 and the cable C2 (that is, the cutout portions CP3 and CP4).

Figure 5A:
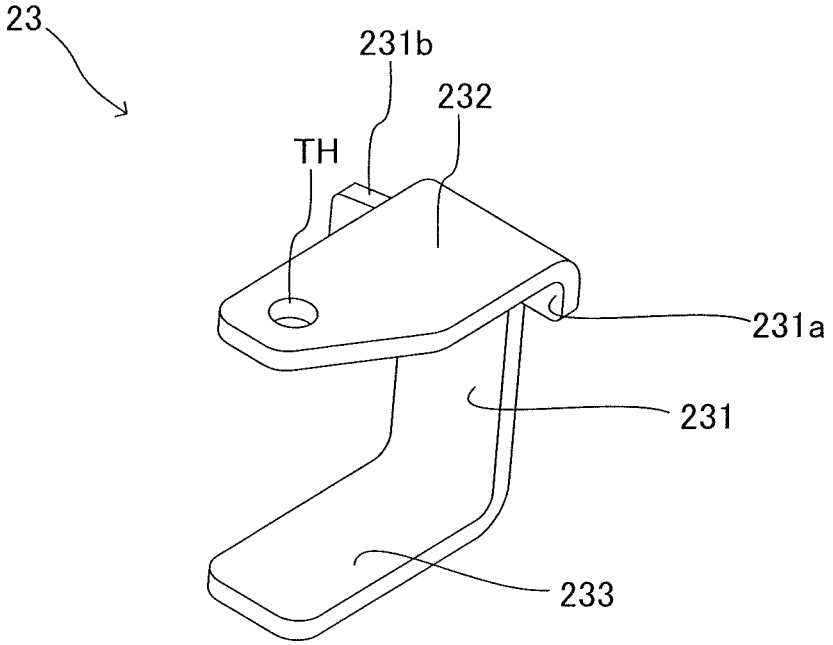
FIG. 5A is a perspective view for illustrating the bracket.
Figure 5B:
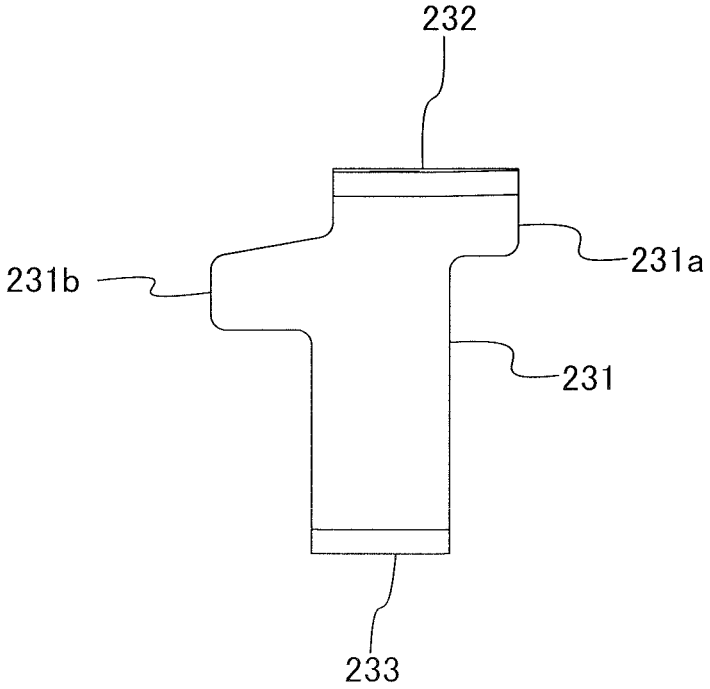
FIG. 5B is a front view for illustrating the bracket.

The bracket 23 is formed by bending a metal plate. As illustrated in FIG. 5A and FIG. 5B, the bracket 23 includes a first wall portion 231, a second wall portion 232, and a third wall portion 233. The first wall portion 231 extends in the right-and-left direction between the cable C1 and the cable C2 in parallel to a wall surface of the peripheral wall portion 212*a* of the second case 212 (see FIG. 4). The second wall portion 232 and the third wall portion 233 extend in the same direction from a left end portion and a right end portion of the first wall portion 231, respectively. The second wall portion 232 and the third wall portion 233 are perpendicular to the first wall portion 231, and the second wall portion 232 and the third wall portion 233 are opposed to each other. The second case 212 and the cover 22 are sandwiched between the second wall portion 232 and the third wall portion 233. When seen from the vehicle interior side, the second wall portion 232 has a substantially pentagonal shape. Specifically, a width of the second wall portion 232 is constant from a base end portion side (first wall portion 231 side) to a vicinity of a center portion of the second wall portion 232 in an extending direction thereof. However, the width of the second wall portion 232 becomes gradually smaller from the vicinity of the center portion toward a distal end portion thereof. A through-hole TH is formed in the distal end portion of the second wall portion 232. Meanwhile, when seen from the vehicle exterior side, the third wall portion 233 has a substantially rectangular shape.

Figure 6:
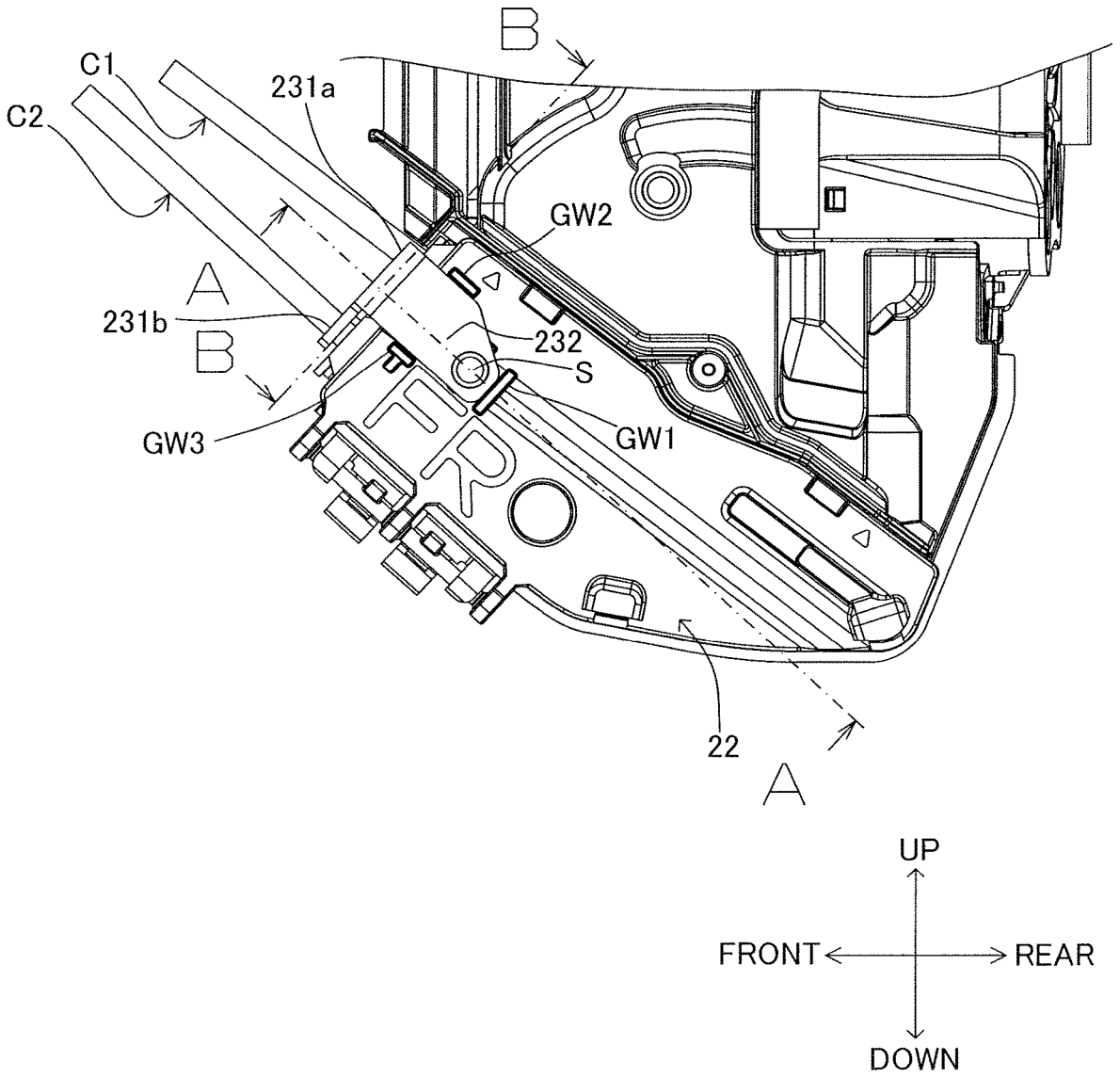
FIG. 6 is an enlarged side view for illustrating a lower end portion of the vehicle door lock device.

Plate-shaped reinforcement portions 231*a* and 231*b* are formed at a left end portion of the first wall portion 231. The reinforcement portions 231*a* and 231*b* protrude in a width direction of the first wall portion 231. The reinforcement portion 231*a* protrudes toward the cable C1 side, and the reinforcement portion 231*b* protrudes toward the cable C2 side (see FIG. 5B and FIG. 6).

Figure 7:
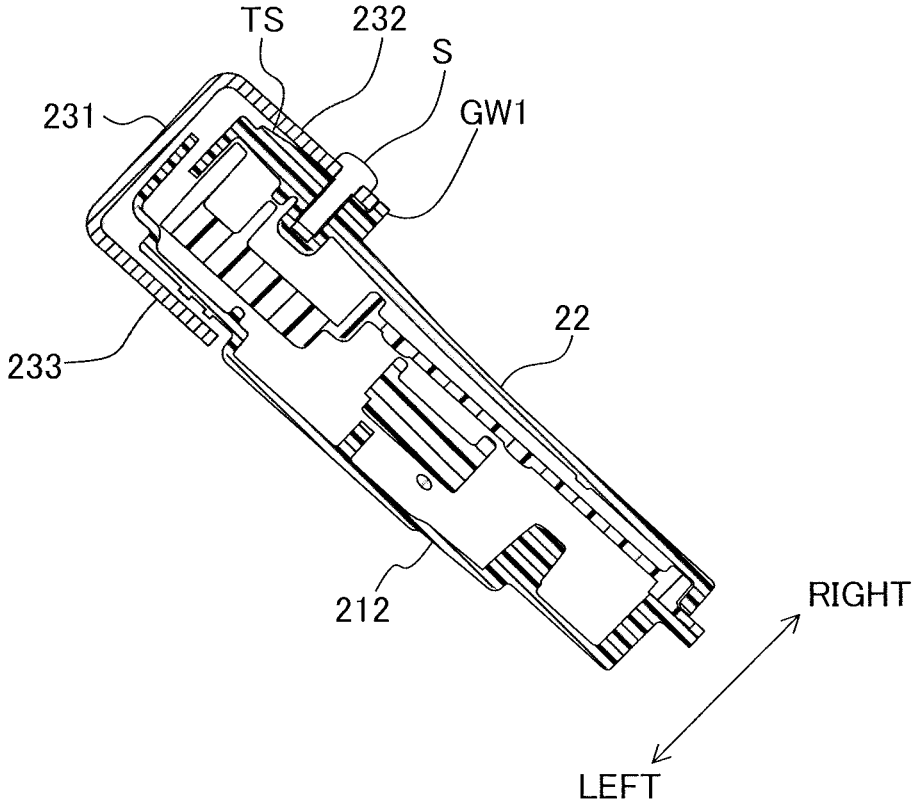
FIG. 7 is a sectional view taken along the line A-A of FIG. 6.

A boss nut BN and guide walls GW1, GW2, and GW3 (a guide portion of the present disclosure) are formed on a side surface portion of the cover 22 on the left side (vehicle interior side) and at the vicinities of the outlets for the cables C1 and C2. Ribs RB1, RB2, RB3, and RB4 are formed on an outer peripheral portion of the boss nut BN (see FIG. 4). The rib RB1 extends from a center side of the boss nut BN toward the peripheral wall portion 212*a* in parallel to the cables C1 and C2. A top surface TS (surface on the vehicle interior side) of the rib RB1 is inclined so that an end portion of the top surface TS on the peripheral wall portion 212*a* side is located on the right side of an end portion of the top surface TS on the boss nut BN side (see FIG. 7). The rib RB2 slightly extends from the center side of the boss nut BN toward a side opposite to the rib RB1 (see FIG. 4). Further, the ribs RB3 and RB4 slightly extend from the center side of the boss nut BN in directions that are opposite to each other and perpendicular to the extending directions of the ribs RB1 and RB2.

The guide walls GW1, GW2, and GW3 are wall portions perpendicular to the side surface portion of the cover 22. The guide walls GW1, GW2, and GW3 function as positioning members for the second wall portion 232. The guide wall GW1 regulates a position of a distal end surface of the second wall portion 232. The guide walls GW2 and GW3 regulate positions of side end surfaces of the second wall portion 232. That is, the guide wall GW1, the guide wall GW2, and the guide wall GW3 are arranged so as to surround the boss nut BN from three directions.

The bracket 23 is inserted between the cable C1 and the cable C2, and the bracket 23 is slid along the cable C1 and the cable C2 to the second case 212 side. Then, the second case 212 and the cover 22 are inserted between the second wall portion 232 and the third wall portion 233. At this time, the second wall portion 232 is slid along the top surface TS of the rib RB1, and is inserted into a space surrounded by the guide walls GW1, GW2, and GW3 (see FIG. 6). Thus, a position and a posture of the second wall portion 232 are determined by the guide walls GW1, GW2, and GW3 so that the through-hole TH of the second wall portion 232 and the boss nut BN are arranged coaxially with each other. Then, a screw S serving as a fastening member of the present disclosure is inserted into the through-hole TH, and is fastened to the boss nut BN. In this manner, the bracket 23 is fixed to the second case 212 and the cover 22. Thus, the second case 212 and the cover 22 are sandwiched between the second wall portion 232 and the third wall portion 233. That is, the second wall portion 232 and the third wall portion 233 function as a pair of sandwiching portions of the present disclosure.

For example, when an outer panel OP of the front door FD is deformed and slightly dented toward the vehicle interior side at the time of collision of the vehicle, the cable C1 and the cable C2 are pressed by the outer panel OP toward the vehicle interior side. Then, the cable C1 and the cable C2 press the cover 22 toward the vehicle interior side (in a direction of opening the cover 22). As described above, in this embodiment, the second case 212 and the cover 22 are sandwiched between the second wall portion 232 and the third wall portion 233 of the bracket 23, and hence the operation of opening the cover 22 is regulated. That is, the closed state of the cover 22 is kept.

Here, assuming that the reinforcement portion 231*a* and the reinforcement portion 231*b* are not formed, when the cable C1 and the cable C2 are pressed toward the vehicle interior side, the cable C1 and the cable C2 are brought into abutment against the cover 22. In this case, an end portion of the cover 22 brought into abutment against the cable C1 and the cable C2 may be deformed or broken. In this embodiment, when the cable C1 and the cable C2 are pressed toward the vehicle interior side, the cable C1 and the cable C2 are brought into abutment against the reinforcement portion 231*a* and the reinforcement portion 231*b* of the metal bracket 23. In this manner, deformation or breakage of the end portion of the cover 22 described above is suppressed.

As described above, a vehicle door lock device (1), including: a housing (20) including: a case (21) having an opening portion (OP); and a cover (22), which is mounted to the case so as to be openable and closable, and is configured to cover the opening portion; a cam mechanism (10), which is accommodated in the housing, and is supported on the case; and a bracket (23, 23A, 23B) configured to restrain a coupling member (C1), which is locked to a locking portion (EP1) formed on the housing, and is configured to connect the cam mechanism and an operation element (DH) provided to a door (FD) of a vehicle from being released from the locking portion when the coupling member connected to the cam mechanism in the opening portion is pressed toward the cover side.

The bracket (23, 23A) includes a pair of sandwiching portions (232 and 233) opposed to each other, and that the case and the cover be inserted between the pair of sandwiching portions.

Further, one (232) of the pair of sandwiching portions on the cover side have a through-hole (TH), and the bracket be fixed to the cover by a fastening member (S) inserted in the through-hole, and that the cover include a guide portion (GW1, GW2, and GW3) configured to determine a position of the bracket through abutment against the bracket, and to prevent the bracket from being rotated about the fastening member.

According to this embodiment, the operation of opening the cover 22 is regulated by the bracket 23, and deformation or breakage of the end portion of the cover 22 is suppressed. Therefore, the holder HP1 of the cable C1 and the holder HP2 of the cable C2 are prevented from being released from the locking portion EP1 and the locking portion EP2, respectively. Thus, even when the outer panel OP of the front door FD is deformed and dented toward the vehicle interior side, the front door FD can be prevented from being opened accidentally.

Further, when carrying out the present disclosure, the present disclosure is not limited to the above-mentioned embodiment, and various modifications may be made without departing from the object of the present disclosure.

Figure 9:
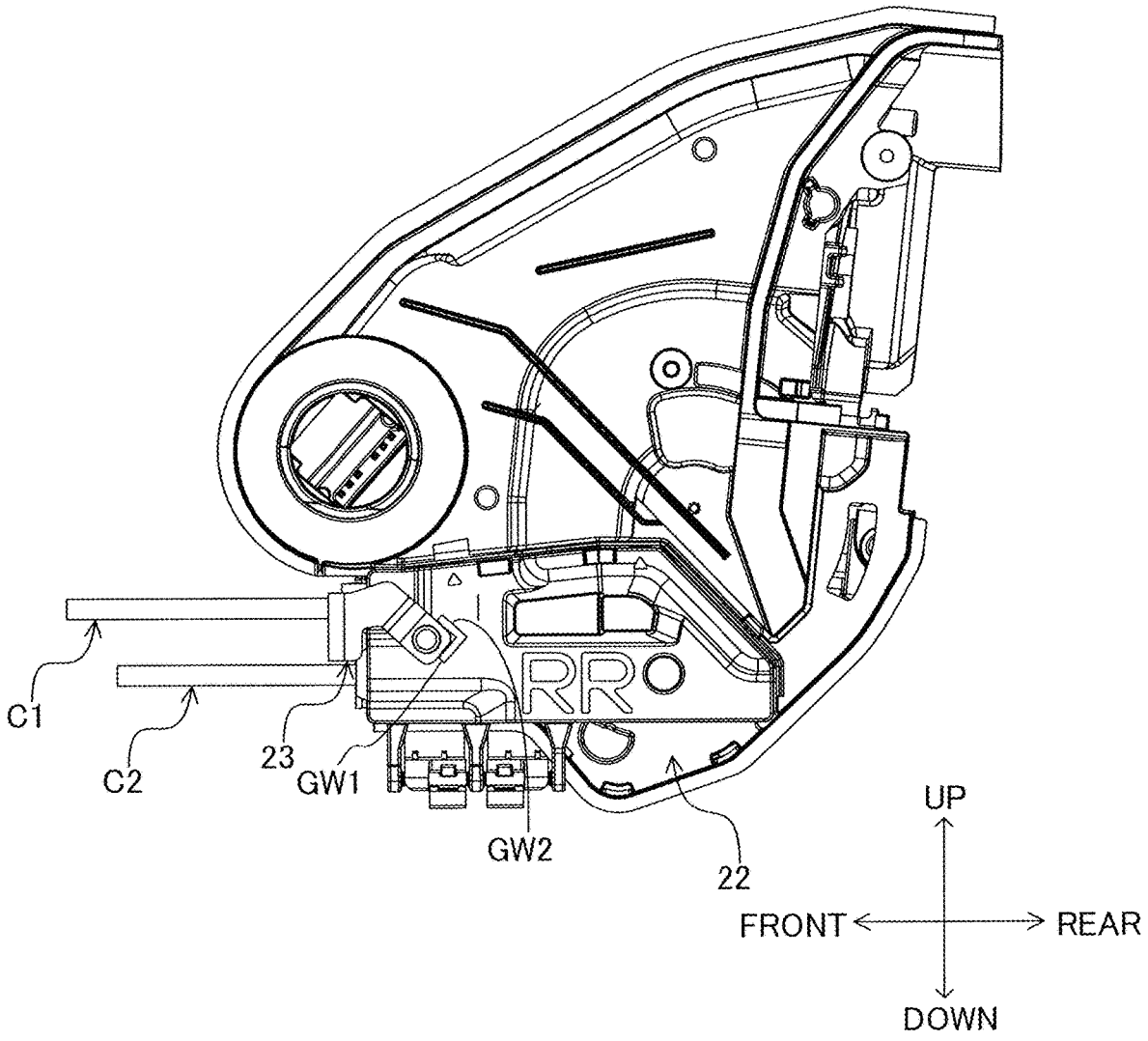
FIG. 9 is a side view for illustrating a vehicle door lock device for a rear door.

The above-mentioned embodiment is an example carried out as the vehicle door lock device 1 applied to the front door FD of the vehicle, but the present disclosure can be carried out as a vehicle door lock device applied to another door (such as a rear door (see FIG. 9)). In the example illustrated in FIG. 9, the guide wall GW3 in the above-mentioned embodiment is not formed, and the position and the posture of the bracket 23 are determined by the guide wall GW1 and the guide wall GW2.

Figure 10:
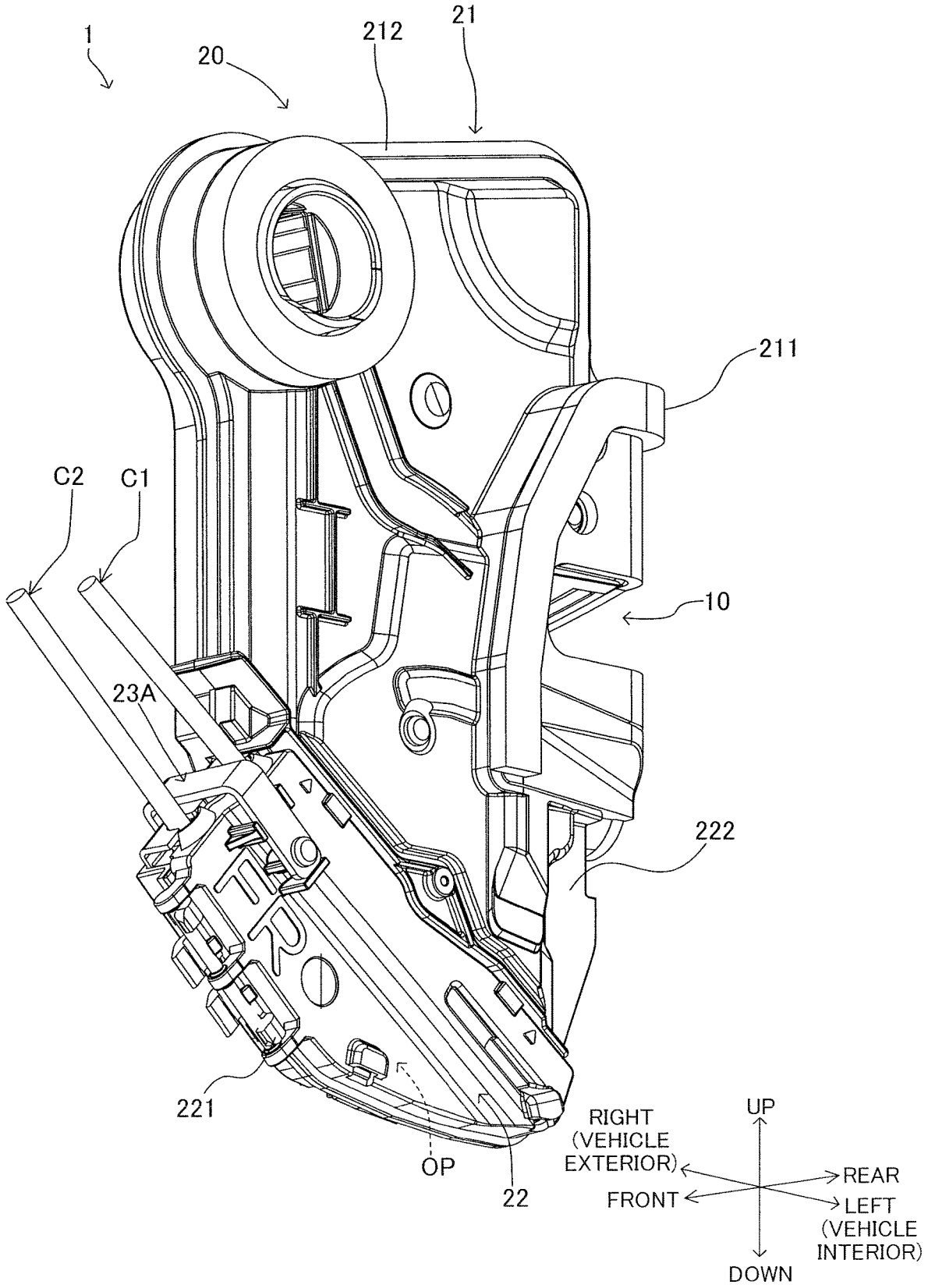
FIG. 10 is a perspective view for illustrating a vehicle door lock device adopting a bracket from which protruding portions are omitted.

Further, when the cover 22 has relatively high rigidity and there is no fear of deformation or breakage of the cover 22 described above, there may be adopted a bracket 23A from which the reinforcement portion 231*a* and the reinforcement portion 231*b* of the bracket 23 are omitted (see FIG. 10). In the above-mentioned embodiment, the bracket 23 is mounted between the cable C1 and the cable C2. When the bracket 23A is adopted, the bracket 23A may be mounted at a position different from the position in the above-mentioned embodiment. However, it is preferred that at least part of a region ranging from the outlets for the cable C1 and the cable C2 to the locking portion EP1 and the locking portion EP2 be sandwiched between the second wall portion 232 and the third wall portion 233.

Figure 11:
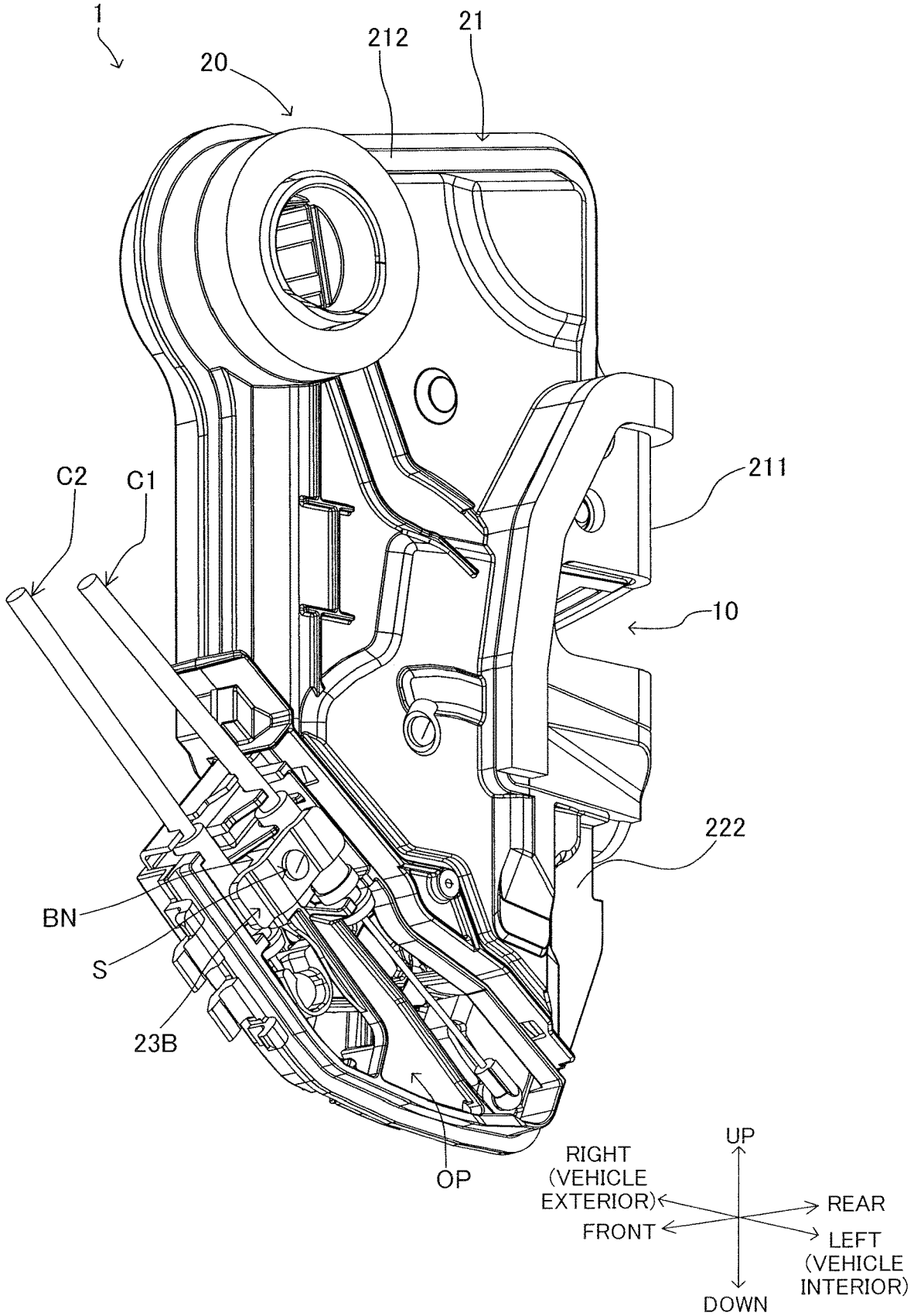
FIG. 11 is a perspective view for illustrating a vehicle door lock device adopting a bracket to be arranged inside an opening portion.
Figure 12:
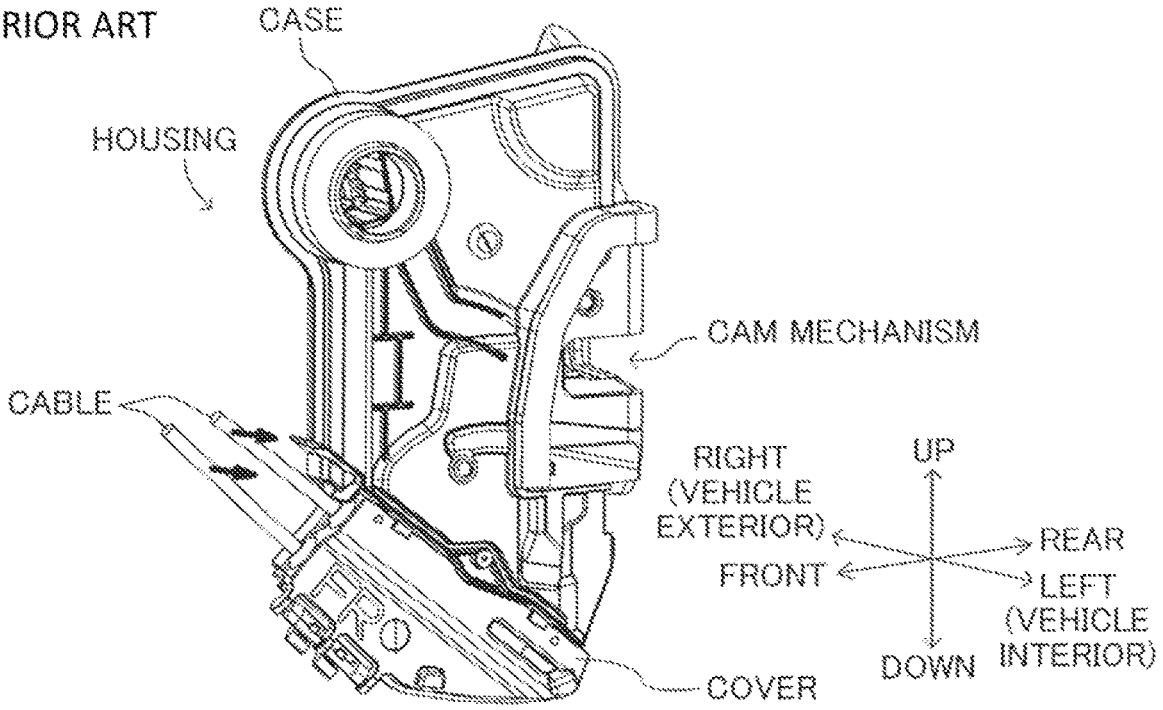
FIG.12 PRIOR ART
FIG. 12 is a perspective view of a related-art vehicle door lock device, for illustrating a state in which cables are pressed toward a vehicle interior side.
Figure 13:
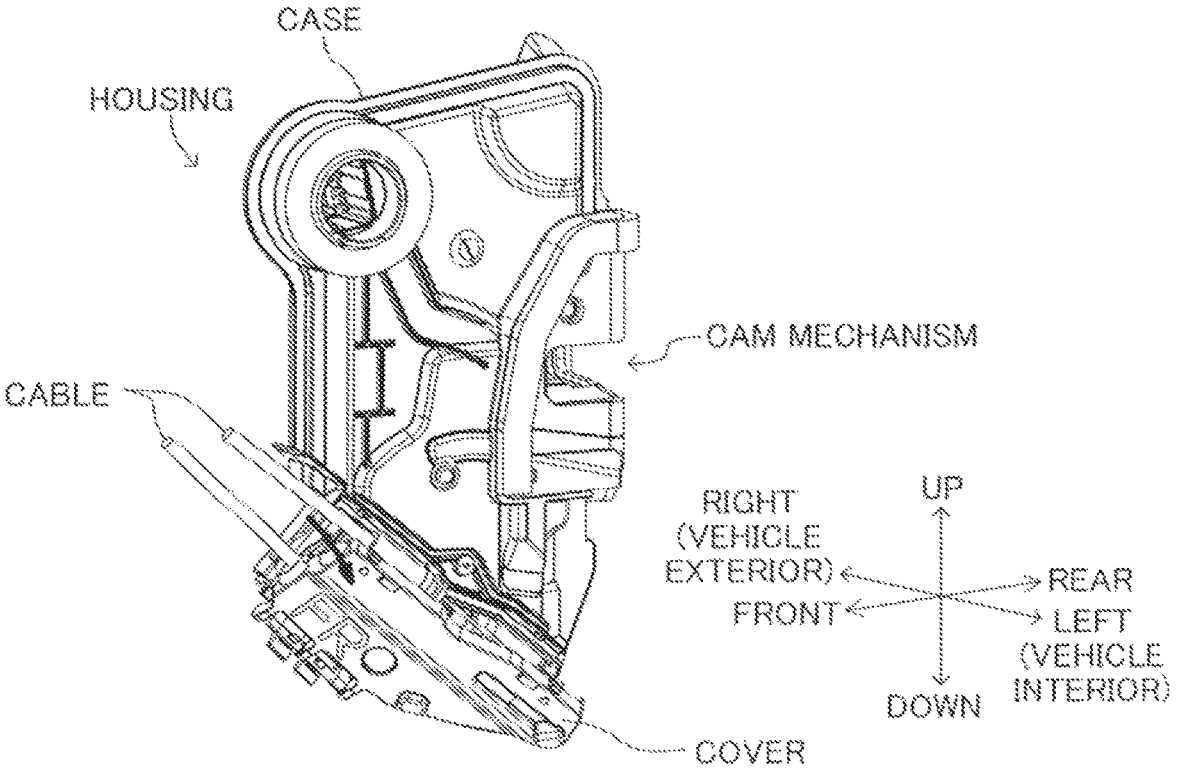
FIG.13 PRIOR ART
FIG. 13 is a perspective view of the related-art vehicle door lock device, for illustrating a state in which the cables press a cover so that the cover is opened.

Further, in place of the bracket 23, a bracket 23B as illustrated in FIG. 11 may be adopted. The bracket 23B is a substantially plate-shaped member. The bracket 23B is arranged in the opening portion OP. The boss nut BN is formed in a region of the opening portion OP of the second case 212 between a side surface portion of the holder HP1 of the cable C1 and the holder HP2 of the cable C2, and the bracket 23B is fastened to the boss nut BN. The bracket 23B extends in a direction perpendicular to the extending directions of the cable C1 and the cable C2 over the side surface portion of the holder HP1 of the cable C1 and the side surface portion of the holder HP2 of the cable C2. Thus, the side surface portion of the holder HP1 of the cable C1 and the holder HP2 of the cable C2 are sandwiched between the second case 212 and the bracket 23B.

As described above, the bracket (23B) is arranged in the opening portion, and be fixed to the case under a state of sandwiching the coupling member (C1) together with the case.

Therefore, the holder HP1 of the cable C1 and the holder HP2 of the cable C2 are prevented from being released from the locking portion EP1 and the locking portion EP2, respectively. Thus, even when the front door FD is deformed, the front door FD can be prevented from being opened accidentally.

The invention claimed is:

1. A vehicle door lock device, comprising:

a housing including:

a case having an opening portion and a locking portion formed therein; and a cover, which is mounted to the case so as to be openable and closable, and is configured to cover the opening portion;

a cam mechanism, which is accommodated in the housing, and is supported on the case;

a pair of cables configured to be inserted through the cover and the case, each of the cables configured to connect the cam mechanism and a respective operation element provided to a door of a vehicle, each of the cables configured to be mounted and locked on the locking portion; and a bracket comprising a main portion mounted between the cables, and a pair of opposed side portions extending from the main portion, the bracket being configured to receive and sandwich the case and the cover together, the cover defining a guide portion configured to position one of the opposed side portions which is fastened to the cover by a fastening member to prevent rotation of the bracket;

wherein during a collision, the bracket is configured to restrain the cables from being released from the locking portion when the cables are pressed toward the cover.

* * * * *